US008292117B2

(12) United States Patent
Guibert et al.

(10) Patent No.: US 8,292,117 B2
(45) Date of Patent: Oct. 23, 2012

(54) STACKABLE WATER HOLDING TANK

(75) Inventors: Philippe Guibert, Saint Macaire en Mauges (FR); Fabien Yvai, Cholet (FR); Stephane Kugener, Chanteau (FR); Tony Calton, Kent CT (GB)

(73) Assignee: Aliaxis Participations, Paris (FR)

( * ) Notice: Subject to any disclaimer, the term of this patent is extended or adjusted under 35 U.S.C. 154(b) by 629 days.

(21) Appl. No.: 12/416,568

(22) Filed: Apr. 1, 2009

(65) Prior Publication Data

US 2009/0250369 A1 Oct. 8, 2009

(30) Foreign Application Priority Data

Apr. 2, 2008 (FR) ..... 08 01833

(51) Int. Cl.
*B65D 1/36* (2006.01)

(52) U.S. Cl. ..... 220/571; 220/501; 220/573; 220/608; 220/669; 220/673; 220/674; 220/675; 206/499; 206/505; 206/507; 206/509; 206/511; 206/557; 62/285; 62/288

(58) Field of Classification Search ..... 62/285, 62/288–291; 206/505–509, 511, 512; 220/501, 220/516, 517, 571, 573, 608, 669, 675, DIG. 2, 220/DIG. 15; D34/38
See application file for complete search history.

(56) References Cited

U.S. PATENT DOCUMENTS 3,420,402 A 1/1969 Frater et al.
3,485,434 A * 12/1969 Donovan et al. ..... 229/406
3,820,341 A 6/1974 Richard et al.
D264,066 S * 4/1982 Smith et al. ..... D34/38
4,930,632 A * 6/1990 Eckert et al. ..... 206/386
D318,552 S * 7/1991 Apps ..... D3/313
D333,028 S * 2/1993 Lux, Jr. ..... D34/38
5,203,578 A * 4/1993 Davidson et al. ..... 280/33.991
5,249,699 A * 10/1993 Williams ..... 220/571
5,253,777 A * 10/1993 Schutz ..... 220/571
5,344,022 A * 9/1994 Stahl ..... 206/507
5,415,293 A * 5/1995 Ackermann et al. ..... 206/506

(Continued)

FOREIGN PATENT DOCUMENTS

AU 199512688 7/1995

(Continued)

OTHER PUBLICATIONS

French Search Report dated Nov. 10, 2008, from corresponding French application.

*Primary Examiner* — Anthony Stashick
*Assistant Examiner* — Ned A Walker
(74) *Attorney, Agent, or Firm* — 24IP Law Group

(57) ABSTRACT

A water holding tank with an approximately rectangular bottom wall and four side walls that are connected respectively to the sides of the bottom wall, each side wall has number of upper support platforms that are arranged periodically along one side of the bottom wall, a number of lower support platforms that are arranged alternately relative to the upper support platforms at a distance from the bottom wall, and a number of connecting walls, whereby each connecting wall connects an upper support platform to a lower support platform while leaving open a passage for water, in which the upper support platforms of a side wall are arranged in mirror positions of the lower support platforms of the opposite side wall relative to a 180° rotation and vice versa.

8 Claims, 6 Drawing Sheets

U.S. PATENT DOCUMENTS

| | | | | |
|---|---|---|---|---|
| D370,765 | S * | 6/1996 | Heintz | D34/38 |
| 6,637,453 | B2 * | 10/2003 | Robinson | 137/312 |
| D562,963 | S * | 2/2008 | Cantolino | D23/386 |
| 7,637,387 | B1 * | 12/2009 | Cantolino | 220/571 |
| 7,673,646 | B1 * | 3/2010 | Cantolino | 137/15.01 |
| 7,878,019 | B2 * | 2/2011 | Cantolino | 62/285 |
| 7,900,795 | B1 * | 3/2011 | Cantolino | 220/608 |
| 2005/0109055 | A1 * | 5/2005 | Goetzinger et al. | 62/291 |
| 2008/0000250 | A1 * | 1/2008 | Cantolino | 62/285 |

FOREIGN PATENT DOCUMENTS

| | | |
|---|---|---|
| AU | 200110081 | 4/2001 |
| DE | 203 03 343 | 7/2003 |
| DE | 20 2005 018 436 | 3/2006 |
| DE | 10 2005 056 131 | 7/2006 |
| EP | 0 943 737 | 9/1999 |
| EP | 0 770 735 | 8/2002 |
| EP | 1 260 640 | 11/2002 |
| EP | 1 416 099 | 5/2004 |
| EP | 1 469 133 | 10/2004 |
| EP | 1 690 989 | 8/2006 |
| EP | 1 743 984 | 1/2007 |
| EP | 1 757 742 | 2/2007 |
| EP | 1 887 145 | 2/2008 |
| EP | 1 932 974 | 2/2009 |
| EP | 1 820 914 | 4/2009 |
| EP | 2 169 127 | 3/2010 |
| FR | 2 499 515 | 8/1982 |
| GB | 2417733 | 11/2008 |
| JP | 63-268823 | 11/1988 |
| JP | 9-112792 | 5/1997 |
| WO | 8802422 | 4/1988 |
| WO | 8802423 | 4/1988 |

* cited by examiner

STACKABLE WATER HOLDING TANK

CROSS-REFERENCE TO RELATED APPLICATIONS

The present application claims benefit of priority to French Application No. 08.01833 filed Apr. 2, 2008.

STATEMENT REGARDING FEDERALLY SPONSORED RESEARCH OR DEVELOPMENT

None.

THE NAMES OF THE PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION (1) Field of the Invention

The field of this invention is that of devices for holding or storing water and more particularly that of the flow of rainwater and its regulation.

(2) Description of Related Art

A certain number of devices for holding rainwater, which have the purpose of a temporary storage or holding of water so as to regulate the flow that runs downstream from a given point in the case of a strong rain or overflow from a gutter, are known. Some of these devices are characterized by a cavity that is buried in the ground that makes it possible to produce a hydraulic buffer between a water intake, whose flow rate is suddenly very high, and a downstream pipe that can handle only a moderate flow rate. The water accumulates there during times of high flow and then evens out downstream through a calibrated drain. Other devices are designed such that the leak rate is set by natural infiltration rather than by a downstream pipe. These devices contribute to reconstituting the water tables when the geological conditions are favorable. Other devices also make it possible to hold the water that is accumulated partially or entirely for a subsequent use.

These devices are in general constituted by parallelepipedic tanks that are made of plastic, with perforated walls to allow the passage of water. They are assembled together so as to constitute a large block that can range from several tens to several thousands of $m^3$, based on the size of the buffer that it is desired to produce. This buffer is placed inside the cavity, itself covered by one or more membranes that make(s) it possible to obtain—according to the type of membranes used—either a volume that is sealed with regard to the terrain in which it is laid and to conserve excess water over the time when it is evacuated via the calibrated drain, or else for a subsequent use, or a permeable volume from which the slow diffusion to the environment operates by infiltration.

Such devices are the object of patent applications such as, for example, the patents or patent applications FR2499515, EP0943737, EP1416099, EP1887145, JP63268823 or JP9112792. They are characterized by holding tanks, stacked two by two head to foot, which are parallelepiped in shape with one face open and the opposite face carrying columns that ensure the retaining structure of the upper tank layer.

So as to support significant weight, the central portion of these tanks is equipped with a large number of columns that, on the one hand, is detrimental to the amount of water that the tank can contain and, on the other hand, requires a large quantity of material to manufacture the tank. Since all of these tanks are manufactured by molding, their price, once the mold is amortized, is greatly dependent upon the quantity of material that constitutes it; the reduction of the volume of material therefore constitutes a competitive advantage that may prove decisive.

BRIEF SUMMARY OF THE INVENTION

This invention has as its object to improve the existing systems by proposing a water holding tank that makes it possible to support large loads (able to range up to 450 kilonewtons per $m^2$ against 30 to 40 kilonewtons per $m^2$ for certain tanks of the prior art), while reducing the quantity of material that is necessary to produce it.

For this purpose, the invention has as its object a water holding tank that comprises an approximately rectangular bottom wall and four side walls that are connected respectively to the sides of the bottom wall, characterized in that each side wall comprises:

- a plurality of upper support platforms arranged periodically along one side of the bottom wall,
- a plurality of lower support platforms arranged alternately relative to the upper support platforms at a distance from the bottom wall, and
- a plurality of connecting walls, whereby each connecting wall connects an upper support platform to a lower support platform while leaving open a passage for water, perpendicular to said wall, in which the upper support platforms of a side wall are arranged in mirror positions of the lower support platforms of the opposite side wall relative to a 180° rotation and vice versa.

Using these characteristics, two identical tanks can be stacked in a position pivoted by 180° from one another, with the lower support platforms of one tank working with the upper support platforms of the tank from below. The connecting walls absorb the compression forces between support platforms. They can be sized to have an advantageous ratio between the acceptable forces of compression and buckling and the necessary quantity of material.

According to a particular embodiment, each connecting wall comprises a thickness portion that connects a thickness side of an upper support platform to a thickness side of a lower support platform, whereby said thickness sides are perpendicular to the side of the bottom wall. Advantageously, each connecting wall also comprises an inside portion that connects the side of the bottom wall to an inner side of a lower support platform, and an outside portion that extends from an outer side of an upper support platform.

Such a shape of the connecting walls offers a good resistance to the compression and to buckling without requiring a large quantity of material.

Preferably, the inside portion and the outside portion are inclined so as to allow an interlocking arrangement of the tank with an identical tank. In this case, a unit of identical tanks can be stored and transported by occupying a limited space.

According to a particular embodiment, the inside portions and/or the outside portions of two adjacent connecting walls delimit a V-shaped slot for the passage of water.

Preferably, the tank comprises four corner sidewall support elements at the corners of the bottom wall, whereby each angular column has a lower platform that is more extended along one side of the bottom wall than another in order to correspond to the alignment of the lower support platforms of the side walls.

According to a particular embodiment, the tank comprises a hole at an upper support platform and a pin at a corresponding lower support platform. This allows a centering of the stacked tanks.

Advantageously, the tank comprises a hoop that surrounds the side walls at the lower support platforms.

Preferably, the outside portion extends between an outer side of an upper support platform and the hoop.

According to a particular embodiment, the hoop has, along two adjacent sides, at least one male attachment and, along the other two sides, at least one female attachment. Advantageously, the male attachment comprises a tab with a T-shaped section that projects beyond the hoop, and the female attachment comprises a receiving groove.

Such a tab can be made without projecting very far beyond the hoop and without constituting a blunt form, while being able to work with the groove of an adjacent tank. The risks of the tab being damaged by shock and the risks of the membranes being damaged by perforation are therefore limited.

To increase the resistance to the compression of tanks, the bottom wall comprises a certain number of hollow columns, extending in the same direction as the connecting walls, toward the open face of the tank, and long enough to work with the bottom wall of the tank that is immediately below when they are stacked. Contrary to the tanks of the prior art, these columns are reduced in number so as not to impair the water capacity of the system and so as to optimize the ratio between the mechanical strength and the quantity of material used.

According to a particular embodiment, and according to the same principle of symmetry of the connecting walls explained above, these columns are arranged in staggered rows so as to allow, in a certain position, the fitting of tanks into one another in a reduced volume that is favorable to transport and to storage, and in the other position, by pivoting by 180° in the plane of the bottom wall, the superposition of the tanks one above the other in a deployed volume corresponding to the operating position.

Furthermore, the arrangement of the columns, in particular their spacing, makes it possible to preserve an adequately large inside volume, free of obstacles, able to accommodate (an) accessory(ies), such as, for example, a drain, or an inspection pipe or a water-flushing pipe. For this purpose, according to a particular embodiment, the free inside volume has the possibility of integrating (an) accessory(ies) of general cylindrical shape or in an upside-down "U," with an adequate section for standard interventions of inspection by a remote-controlled camera and cleaning by water flushing. This (these) accessory(ies) are then found locked laterally by the columns inside the tanks and can be extended through several consecutive tanks in a rectilinear arrangement that is favorable in both the targeted function and in the ease of installation. The fact of being able to use this(these) accessory (ies) in a single rectilinear segment through the structure makes it possible, without complicating the facility at all, to supply in advance a jacket of the geotextile type or other permeable fabric that acts as a filter that is able to hold up any solid element of adequate size inside said accessory(ies). The water that passes through the filtering media toward the holding cavity will thus be filtered. The confinement of the impurities inside said accessory(ies) is conducive to the maintenance interventions mentioned above.

To correspond to this installation option that will be named "inspection" or "water-flush," the walls of the tanks can be locally scalloped so as to let the tubular elements pass through from one side to the other. This modification offers the advantage of authorizing the sequential placement of plates at the excavation bottom, then tubular accessories of any length, and then tanks. This sequence is clearly advantageous in terms of ease of placement and saving time, compared to the prior art, which requires the lateral insertion of tubular accessories through the tanks after their installation in the holding cavity. It is still more advantageous in the case of the laying of a tubular accessory that is equipped with a filtering medium on its outside face.

The interlacing of crossed ribs that constitutes the bottom of the tank comprises, in two symmetrical locations relative to the geometric axes of the bottom, meshes whose spacing is essentially wider than all of the surrounding meshes. These particular dimensions of meshes, as well as their location, have been selected to allow the user to grasp the tank by sliding his fingers, optionally protected by gloves, inside the meshes and to handle the tank with two hands, spaced by about one shoulder-width. Using this configuration, the user can handle the naturally balanced load without outside assistance under good ergonomic conditions. To make handling even more comfortable, the rib that is used as a handle has a rounded section in the gripping area.

So as to impart the same mechanical strength to the first layer of tanks, at the bottom of the cavity, as to the upper layers of the work, it is necessary to offer to said tanks the same conditions of support and wedging as to the upper layers. According to a particular embodiment, these initial support and wedging functions are obtained by the use of plates of generally flat shape, able to be interlocked under the lower face of the tanks, at a rate of one plate per tank, consequently being inserted between the membrane(s) of the bottom of the cavity and the lower support platforms of the tanks. These plates have a total support area that is clearly higher than the sum of the areas of the lower support surfaces of the tanks and are consequently able to reduce the risk of damage by perforation of the membrane(s).

According to a particular embodiment, the plate comprises at least one peripheral upper support platform that works with a plurality of lower support platforms of the tank. The rectangular format of the plate offers dimensions that are slightly less than the dimensions of the hoop of the side walls of the tank, which makes it possible to fit the plate inside the hoop, producing in this a centering of one part relative to another. The peripheral upper support platform of the plate offers, analogously to the upper support platforms of the tanks, holes that can work with the studs of the lower support platforms of the tanks. These additional fittings have the function of preventing the connecting walls of the tanks from sliding toward the outside of the lift rectangle under the combined forces of compression and buckling that are undergone when in operation. In this assembly position, the columns of the tanks are supported on the surface of the plates so as to transfer the load to the ground.

To facilitate the composition of the first layer of the work, the plate can advantageously be fixed in the tank in the final assembly position before its definitive installation at the bottom of the holding cavity. The handling of the tanks of the first layer, and their associated plate, consequently is done simultaneously, resulting in a much greater ease of positioning and saving time. According to a particular embodiment, the attachment of the plates under the tanks is done by "clip"-type hooking at the end of the columns of the tanks that are equipped for this purpose with a corresponding hole.

BRIEF DESCRIPTION OF THE SEVERAL VIEWS OF THE DRAWINGS

The invention will be better understood, and other objects, details, characteristics and advantages of the latter will appear more clearly during the detailed explanatory description that will follow of an embodiment of the invention that is provided by way of purely illustrative and non-limiting example, with reference to the accompanying diagrammatic drawings.

In these drawings.

DETAILED DESCRIPTION OF THE INVENTION

Figure 1:
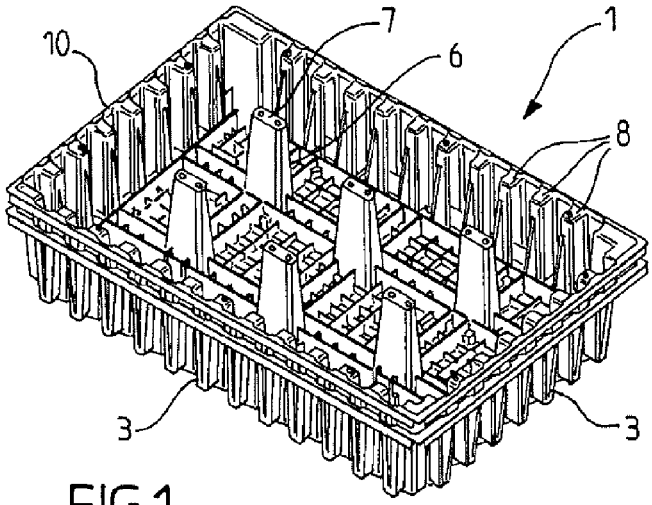
FIG. 1 is a perspective view of two water holding tanks according to an embodiment of the invention, interlocked in one another in position for their transport or their storage.
Figure 2:
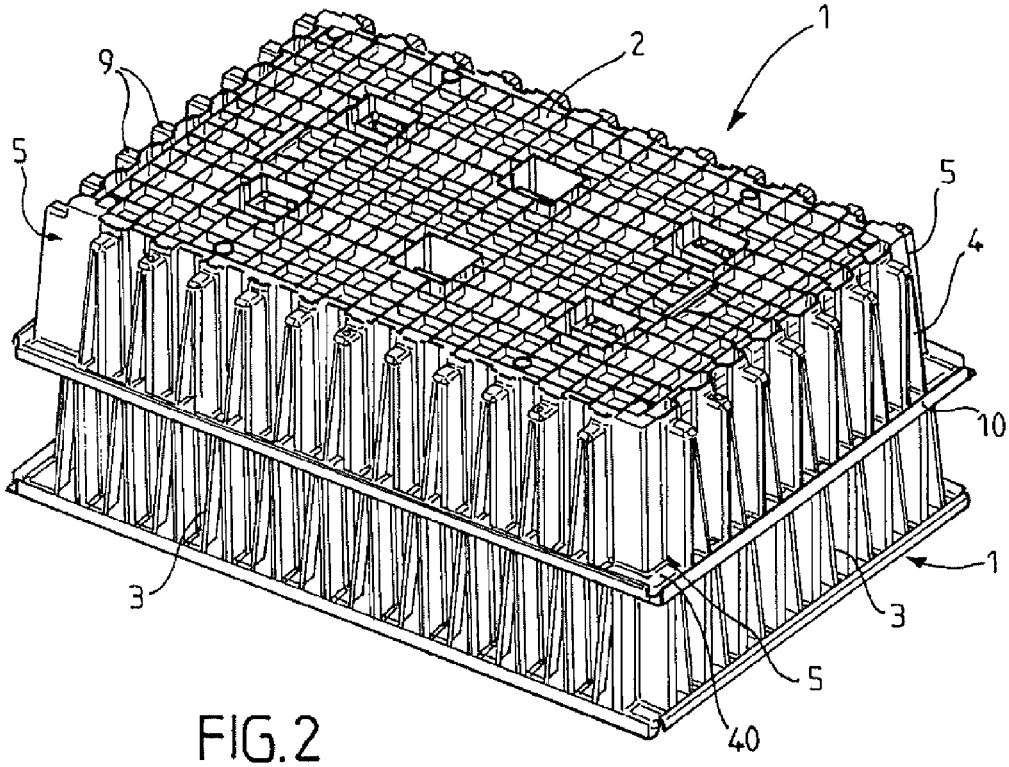
FIG. 2 is a perspective view of the two tanks of FIG. 1, one positioned on the other for the production of a water holding buffer.

In referring to FIGS. 1 and 2, a set of two identical tanks 1 is seen; they are interlocked in one another in FIG. 1 and turned, and then stacked on one another in FIG. 2. So as to be able to stack them on one another, as they are seen in FIG. 2, a rotation of 180° relative to the lower tank is executed on the upper tank in a horizontal plane. The support points on each of these tanks are arranged so that, before being turned 180°, they are in a position where interlocking is possible and so that, after this turn, it is the stack that it becomes.

The tanks 1 have an essentially parallelepiped shape, comprising a bottom wall 2, conventionally designated as the upper part of the tank (because of its position when the tanks are stacked as in FIG. 2), which has the shape of a grid that consists of a set of short, interlaced, vertical walls. They also have side walls 3 that are formed by a series of columns 4 in the shape of a V and an upside-down V, which follow one another alternately. This V shape is defined so as to allow the interlocking of the tanks, one in the other, for storage or transport. So as to ensure support points for the interlocking or stacking of the tanks, these Vs and upside-down Vs are truncated close to their pointed end, so as to make flat lower support platforms 8 appear beside the open face and flat upper support platforms 9 appear beside the bottom wall 2. The side walls 3 thus come in the form of a strip with a given width, unrolling along the Vs and upside-down Vs as well as their support platforms. The width of the strip is determined based on the load that the tank 1 is supposed to support.

Figure 3:
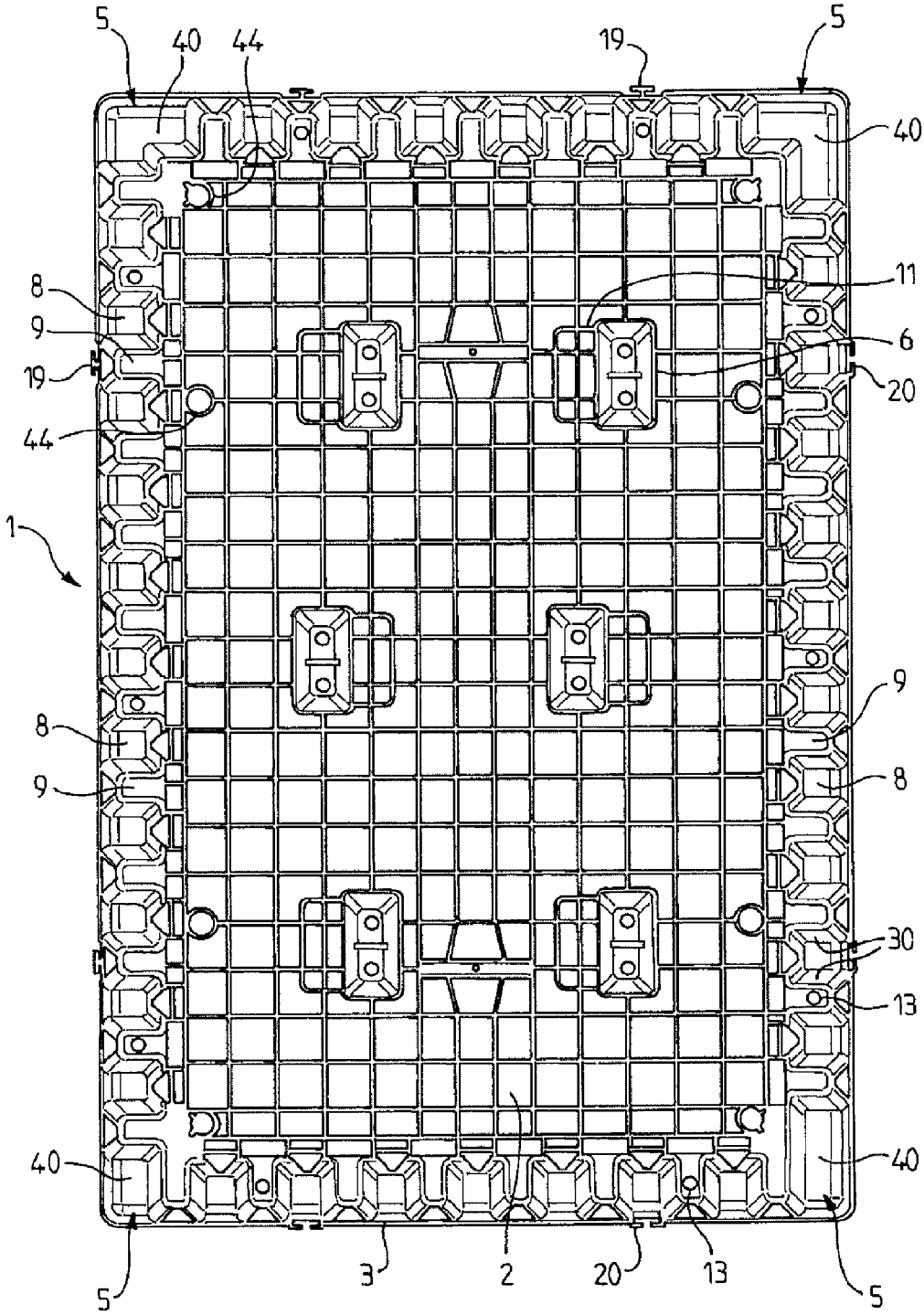
FIG. 3 is a top view of one of the tanks of FIG. 2.
Figure 7:
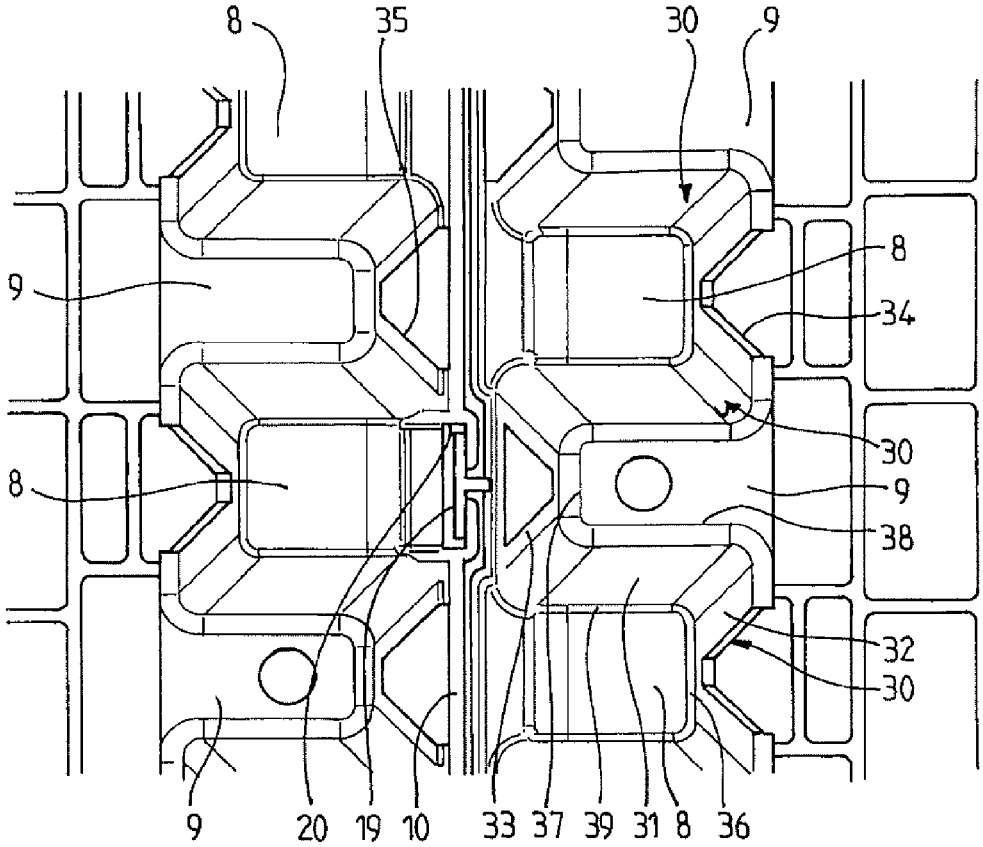
FIG. 7 is a top view of a hooking device that makes it possible to hook the two tanks of FIG. 1 when they are arranged side by side.

The structure of the side walls 3 is described in more detail in references to FIGS. 3 and 7. As explained above, a side wall 3 comprises a plurality of upper support platforms 9 that are arranged periodically along one side of the bottom wall 2. The lower support platforms 8 are arranged alternately relative to the upper support platforms 9 at a distance from the bottom wall 2. As can be seen in FIG. 3, the upper support platforms 9 of a side wall 3 are arranged in mirror positions of the lower support platforms 8 of the opposite side wall 3 relative to the geometric axis that passes through the center of the bottom of the tank and perpendicular to the bottom of the tank. Thus, a pivoting of a tank by 180° relative to this axis puts the lower platforms 8 of a tank to the right of the upper platforms 9 of a tank that is placed below. This allows a stacking of several identical tanks 1 as shown in FIG. 2.

Each side wall 3 also comprises a plurality of connecting walls 30 that connect the upper support platforms 9 to the lower support platforms 8 by absorbing the compression forces. As FIG. 7 shows, an upper support platform 9 is connected to two adjacent lower support platforms 8 respectively by two symmetrical connecting walls 30. One connecting wall 30 comprises an inside portion 32, located on the side of the interior of tank 1, a thickness portion 31, arranged in the thickness of the side wall 3, and an outside portion 33, located on the side of the exterior of the tank 1. The inside portion 32 extends between the side of the bottom wall 2 and an inner side 36 of a lower support platform 8. The thickness portion 31 extends between a thickness side 38 of an upper support platform 9 and a thickness side 39 of an adjacent lower support platform 8. Finally, the outside portion 33 extends between an outer side 37 of an upper support wall 9 and a hoop 10 that will be described below.

The inside portion 32, the thickness portion 31, and the outside portion 33 of the connecting walls 30 are inclined so as to form the columns 4 that, as stated above, are tapered so as to allow an interlocking of several identical tanks 1 as in FIG. 1.

As can be seen in FIG. 7, the inside portions 32 of two adjacent connecting walls 30 delimit a V-shaped slot 34 for the passage of water. Similarly, the outside portions 33 of two adjacent connecting walls 30 delimit a slot 35, which is also V-shaped, for the passage of water.

The side walls 3 combine at four angles and are attached to one another by corner sidewall support elements 5. The upper and lower faces of these corner sidewall support elements 5 are arranged, in a known way, so as to allow the interlocking of tanks 1 as illustrated in FIG. 1, and their stacking as illustrated in FIG. 2 after the pivoting by 180° of one tank of two. As can be seen in FIG. 3, the lower faces 40 of the various corner sidewall support elements 5 are more or less extended along the sides of the tank 1 so as to introduce the above-mentioned offset between the support platforms from opposite sides.

Inside the central volume of the parallelepiped, columns 6 that extend from the bottom 2 in the direction of the open face and that end in a foot 7 of a column in the form of a flat lower shoulder, which is parallel to the bottom 2 and located approximately at the same height as the lower platforms 8 of the columns 4 of the side walls 3 and as those of the corner sidewall support elements 5, are seen.

The lower parts of the side walls 3 are clamped and held together by a hoop 10 that ensures the cohesion of the columns 4 and corner sidewall support elements 5 and thus ensures that there is no major deviation among side walls 3 when the tank 1 rests on its open part and when significant loads are placed on top.

Figure 4:
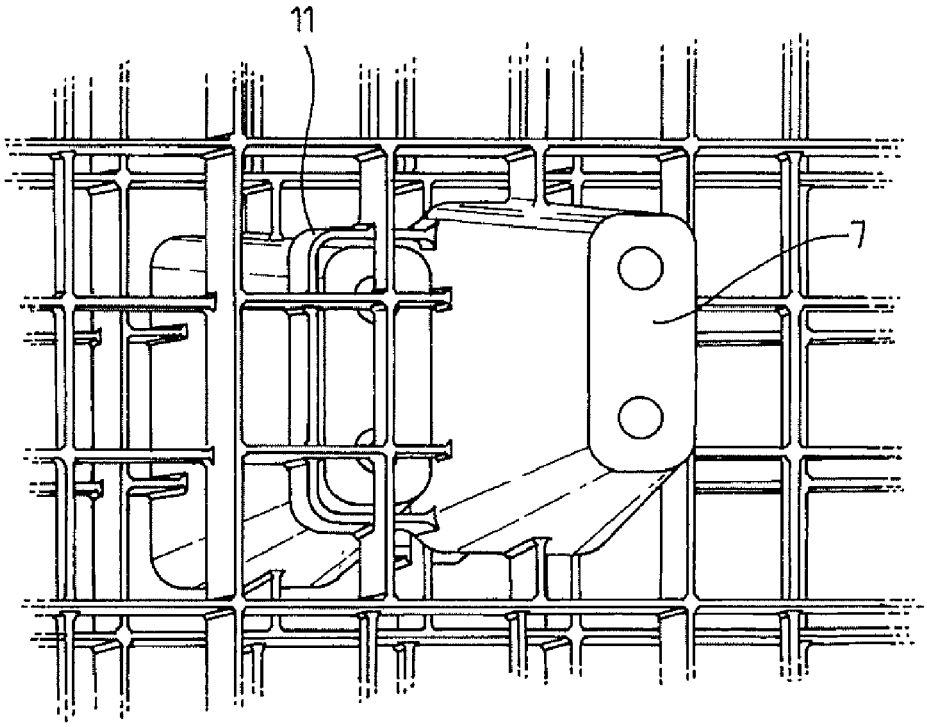
FIG. 4 is a detail view, from below, of the tanks of FIG. 2, stacked one on the other.

In reference to FIG. 3, a tank 1 is seen in the position of FIG. 2, in top view, with the columns 4 of the side walls and the corner sidewall support elements 5 as well as the columns 6 that have a cone shape to allow their interlocking. The bottom of the foot 7 of the column is pierced by holes to allow the flow of water and to prevent the column from constituting a receptacle where water would stagnate. On the bottom 2 of the tank, alongside the tops of the columns 6, supports 11 for the feet 7 of columns of the tank of the top are positioned. When the tanks 1 are stacked, each column foot is positioned inside a support 11 that rests on the bottom of the bottom tank so as to be held in translation in the two directions of the horizontal plane. Each column foot support 11 is arranged on the bottom 2 in a position that corresponds to the image of the foot of a column 6 relative to the axis of pivoting of the tank 1. It will be noted that to allow the input of the column foot 7 into the support 11, the columns 6 have a length that is slightly more than that of the columns 4 of the side walls 3 or than that of the corner sidewall support elements 5. Likewise, as can be seen in FIG. 4, at supports 11, the grid walls that form the bottom 2 have lengths that are slightly shortened to allow the entry of feet 7 of columns into the corresponding supports 11.

The gripping handles 45 that are incorporated in the bottoms 2 of the tanks 1 are also distinguished in FIG. 3. These handles, of which there are two per tank, are distributed so as to naturally balance the load for easy handling by a single operator. Their rounded shape and their dimensions make possible a comfortable grip.

Figure 5:
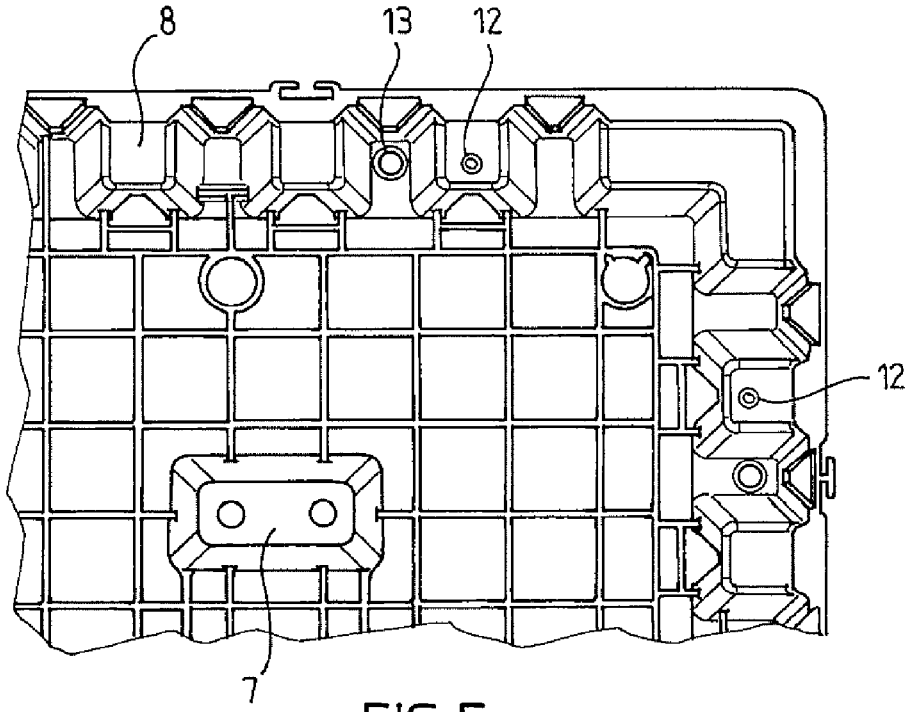
FIG. 5 is a partial bottom view of the tank of FIG. 3.

In reference to FIG. 5, for the purpose of finding good centering of a tank 1 on the one that supports it but also for the purpose of preventing one of the side walls 3 from curving laterally under the weight that it supports, centering pins 12 are positioned on certain lower platforms 8 of each side wall 3, and, in parallel, holes 13 are made in the upper platforms 9 that have locations that correspond to the lower platforms 8 that they will support after the pivoting by 180°.

Figure 6:
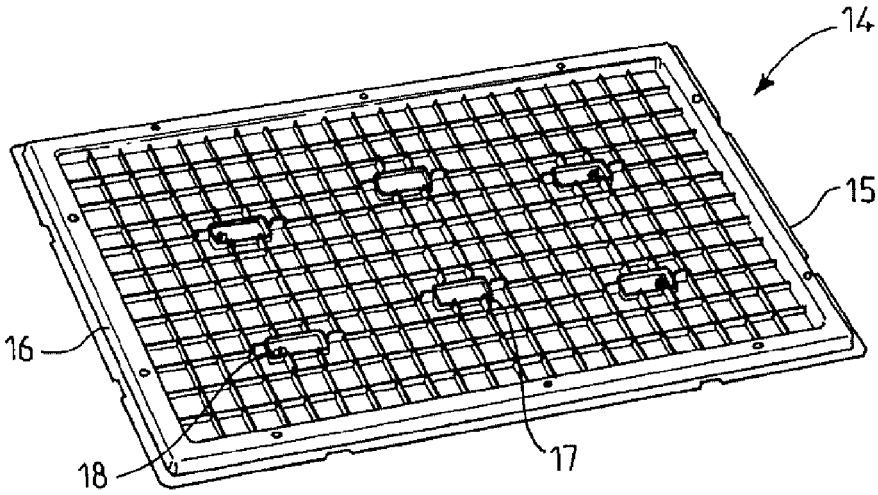
FIG. 6 is a perspective view of a tank holding plate, according to an embodiment of the invention.

In reference to FIG. 6, a plate 14 is seen that is designed to be placed at the excavation bottom and to be used as support to the tanks 1 that are placed lowest in the excavation. Found on this plate 14 are all of the elements that appear on tanks 1 that allow the stacking of an identical tank immediately above, i.e., a support environment 15 that fills the same function as the series of upper platforms 9, holes 16 in which the studs 12 of the tanks of the lower stage are positioned, and column supports 17 that play the role of supports 11 of tanks 1. Unlike supports 11 of tanks 1, these column supports 17 are solid and are each a carrier of a clip 18 that can pass through the holes of the feet of the columns of the excavation bottom tanks. The presence of this clip 18 makes it possible—if the plates 14 are put at the bottom of the excavation in advance—to duly center the tanks 1 relative to one another and in the contrary case to make the tanks integral with the plates before their installation and therefore to handle them more easily. Owing to this simultaneous handling possibility of plates 14 and tanks 1, assembled for the first lowest layer of the excavation, it is not necessary to equip the plates 14 with the same gripping handles 45 as those integrated in the bottoms 2 of tanks 1

In referring to FIG. 7, a device for hooking two tanks 1, positioned side by side as they are for constituting a water storage buffer, is seen. On the lateral edge of the hoop 10, two T-shaped male attachments 19 are positioned on two adjacent sides, and female attachments 20 in the form of grooves are positioned on the other two adjacent sides. As can be seen in FIG. 7, the male attachments 19 can work with the female attachments to prevent any lateral movement of a tank 1 relative to the tank to which it is connected. The arrangement of the two male attachments on two adjacent sides and two female attachments on the other two adjacent sides makes possible an assembly of tanks on the same layer according to an undifferentiated sequence, i.e., that the deployment of the tanks can be done by first assembling the small sides to form a line of great length or else first the large sides to form a line of great width. It is also possible to proceed in parallel along the small sides and large sides, which provides all of the flexibility that is necessary for the creation of the worksite. It thus is not necessary to expect that the entire excavation be completed before beginning to assemble the tanks, both horizontally and vertically.

Figure 8:
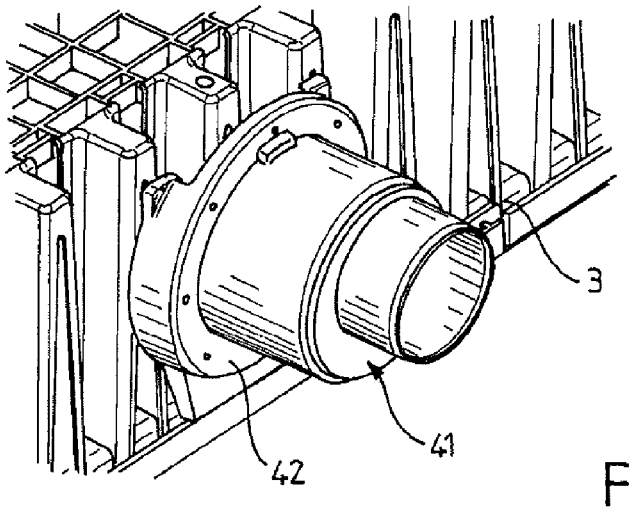
FIG. 8 is a perspective view of a connection that is attached to the side wall of the tank of FIG. 3.

In FIG. 8, a connection 41 that is attached to the side wall 3 of a tank 1 is seen. The connection 41 makes it possible to connect the hydraulic buffer to a pipe for the supply of the basin, the draining or the leakage of the basin, or the creation of an air vent or an overflow. The connection 41 comprises a connecting sleeve that makes possible the connection to the pipe and means for attachment to the side wall 3 of a tank 1. For example, it may involve a means working with the above-mentioned slots 35 and with the hoop 10 so as to attach the connection 41 by clamping. This hooking method advantageously makes it possible to use the connection 41 equally at one or the other of the walls 3 of the tanks 1, at one or at the other slots 35 in combination with the hoop 10, at any level of the stacking, without any prior preparation of the tanks 1. This special feature ensures great modularity in the laying of pipes for feeding and draining the basin. The connection 41 has a flat annular surface 42 that allows, with a flange, not shown, the attachment of the geomembrane to the connection 41 in a sealed manner.

Figure 9:
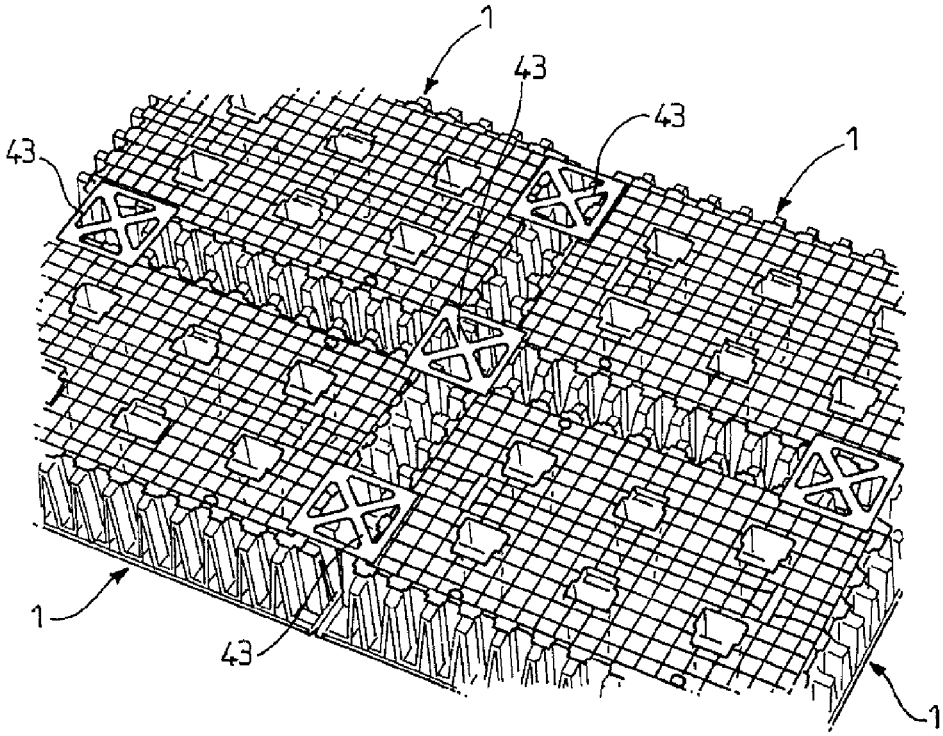
FIG. 9 is a top perspective view of several tanks of FIG. 2 that form the upper face of a hydraulic buffer.

FIG. 9 is a perspective top view of several tanks 1 that form the upper face of a hydraulic buffer. Several connectors 43 that are equipped with perpendicular outgrowths (not shown) that connect two or four adjacent tanks 1 can be seen there. The connectors 43 offer the geomembrane a support surface to prevent it from being pierced under the weight of the terrain that pushes it into the spaces between the tanks 1. FIG. 3 shows that the tanks 1 have, at their bottom wall 2, eyelets 44 that make possible the attachment of the connectors 43, for example by clamping.

Figure 10:
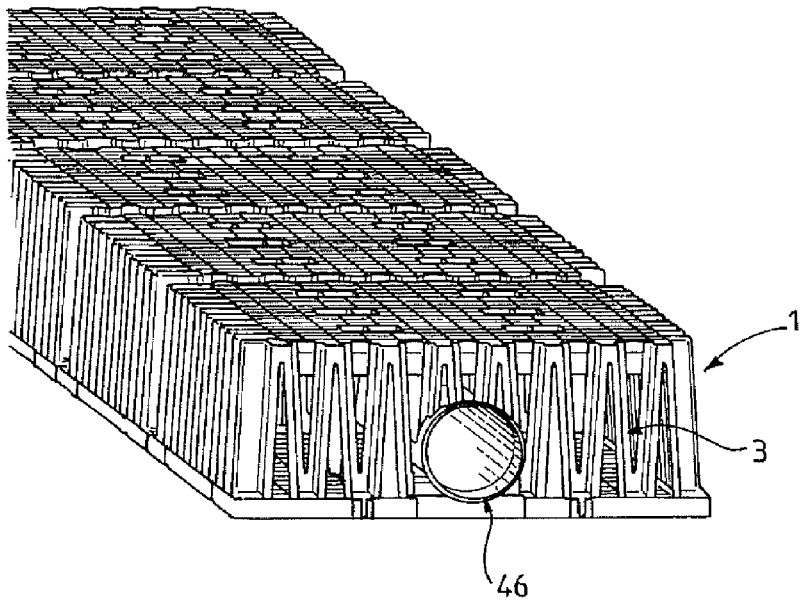
FIG. 10 is a perspective view of several tanks, installed according to the "inspection" or "water-flush" option, with the corresponding accessory.

FIG. 10 exhibits several tanks 1 that are juxtaposed when in operation, offering the "inspection" or "water-flush" option. The side walls 3 of the small sides of the tanks 1 are scalloped by machining so as to allow the passage all the way through tanks 1 by a tubular accessory 46 that constitutes a drain, or an inspection channel for the inspection by remote-controlled camera, or a water-flushing channel. This tubular accessory 46 may have any length and can be placed at the excavation bottom in one or more segments, on plates 14, and then covered by tanks 1 while preserving its straight line.

Although the invention has been described in relation to a special embodiment, it is quite obvious that it is in no way limiting and that it comprises all of the technical equivalents of the means that are described as well as their combinations if the latter come within the scope of the invention.

The invention claimed is:

1. A water holding tank (1) that is designed to constitute, by assembly of tanks, a water holding device that is buried in the ground, the water holding tank comprising:

an approximately rectangular bottom wall (2) having four sides and four corners;

four support elements located respectively at each corner, each support element having a lower platform (40) that is longer along a first one of the sides than a second one of the sides;

four side walls (3) connected respectively to the sides of the bottom wall, each side wall comprising:

a plurality of upper support platforms (9) that are arranged periodically along one side of the bottom wall, a plurality of lower support platforms (8) that are arranged alternately relative to the upper support platforms at a distance from the bottom wall, and a plurality of connecting walls (30), each connecting wall connects an upper support platform to a lower support platform while allowing for a passage of water, each connecting wall comprises:

a thickness portion (31) that connects a thickness side (38) of one of the upper support platforms (9) to a thickness side (39) of one of the lower support platforms (8), an inside portion (32) that connects one of the sides of the bottom wall (2) to an inner side (36) of one of the lower support platforms (8), and an outside portion (33) that extends from an outer side (37) of one of the upper support platforms (9);

the upper support platforms of a first one of the side walls are arranged in mirror positions of the lower support platforms of a second one of the side walls;

wherein the inside portion and the outside portion are inclined allowing for having an interlocking arrangement of the water holding tank (1) with a second identical water holding tank.

2. The water holding tank according to claim 1, wherein the inside portions or the outside portions of a first one the connecting walls adjacent a second one of the connecting walls delimit a V-shaped slot (34, 35) for passage of water.

3. The water holding tank according to claim 1, comprising a hole (13) at one of an upper support platforms (9), and a stud (12) at one of the lower support platforms (8).

4. The water holding tank according to claim 1, wherein the bottom wall has a plurality of hollow columns that extend in the same direction as the side walls up to an open face of the water holding tank.

5. The water holding tank according to claim 1, wherein the bottom wall has eyelets (44) that are designed for the attachment of connectors.

6. The water holding tank according to claim 1, comprising a hoop (10) that surrounds the side walls (3) at the lower support platforms (8).

7. The water holding tank according to claim 6, wherein the outside portion (33) of each connecting wall extends between an outer side (37) of an upper support platforms (9) and the hoop (10).

8. The water holding tank according to claim 6, wherein the hoop has, along two adjacent hoop sides, at least one male attachment (19) and, along two other hoop sides, at least one female attachment (20).

* * * * *